US008280725B2

(12) United States Patent
Sun

(10) Patent No.: US 8,280,725 B2
(45) Date of Patent: Oct. 2, 2012

(54) PITCH OR PERIODICITY ESTIMATION

(75) Inventor: Xuejing Sun, Rochester Hills, MI (US)

(73) Assignee: Cambridge Silicon Radio Limited, Cambridge (GB)

( * ) Notice: Subject to any disclaimer, the term of this patent is extended or adjusted under 35 U.S.C. 154(b) by 729 days.

(21) Appl. No.: 12/474,004

(22) Filed: May 28, 2009

(65) Prior Publication Data

US 2010/0305944 A1 Dec. 2, 2010

(51) Int. Cl.
*G10L 11/04* (2006.01)

(52) U.S. Cl. ..... 704/207

(58) Field of Classification Search ..... 704/207
See application file for complete search history.

(56) References Cited

U.S. PATENT DOCUMENTS 5,819,213 A * 10/1998 Oshikiri et al. ..... 704/222
7,233,847 B2 * 6/2007 Otsuka ..... 701/30.6
7,272,556 B1 * 9/2007 Aguilar et al. ..... 704/230
7,552,048 B2 * 6/2009 Xu et al. ..... 704/206
7,565,286 B2 * 7/2009 Gracie et al. ..... 704/217

* cited by examiner

*Primary Examiner* — Susan McFadden
(74) *Attorney, Agent, or Firm* — Novak Druce DeLuca+Quigg LLP

(57) ABSTRACT

A method of estimating a pitch period of a first portion of a signal wherein the first portion overlaps a previous portion. The method comprises computing a first autocorrelation value for part of the first portion not overlapping the previous portion. The method further comprises retrieving a stored second autocorrelation value for part of the first portion overlapping the previous portion, the second autocorrelation value having been computed during estimation of a pitch period of the previous portion. The method further comprises forming a combined autocorrelation value using the first and second autocorrelation values, and selecting the estimated pitch period in dependence on the combined autocorrelation value.

17 Claims, 5 Drawing Sheets

PITCH OR PERIODICITY ESTIMATION

FIELD OF THE INVENTION

This invention relates to estimating the pitch period or periodicity of a portion of a signal, and in particular to reducing the algorithmic complexity associated with such estimations.

BACKGROUND OF THE INVENTION

Voice signals are quasi-periodic. In other words, when viewed over a short time interval a voice signal appears to be composed of a substantially repeating segment. The time period of the repetition of the segment is referred to as a pitch period.

The periodicity (also known as harmonicity) of a signal is a measure of the degree to which the signal exhibits periodic characteristics, in other words it is a quality measure of how regularly recurrent the signal is. Some signals are periodic even when viewed over long time intervals, for example pure tones. Such signals have a very high degree of periodicity. Other signals are not periodic, for example noise signals. Such signals have a very low degree of periodicity. Voice signals are quasi-periodic. They exhibit a high degree of periodicity if the periodicity is measured over short time intervals.

Pitch period and/or periodicity estimates of a signal are used in many applications in speech processing systems. For example, such estimates are often used in speech noise reduction processes, speech recognition processes, speech compression processes and packet loss concealment processes.

An estimate of the periodicity of a signal is often used to distinguish the voicing status of the signal. If the periodicity is low, the signal is considered to be unvoiced speech or noise. If the periodicity is high, the signal is considered to be voiced.

The estimate of the pitch period of a signal may, for example, be used to aid in selecting a replacement packet of data in a packet loss concealment process.

Many methods are used to estimate the pitch period and periodicity of a voice signal. Generally, these methods include use of an autocorrelation algorithm. Suitable algorithms include the average magnitude difference function (AMDF), the average squared difference function (ASDF), and normalised cross-correlation function (NCC). For a typical one of these methods, the calculations involved in estimating the pitch period or periodicity account for over 90% of the algorithmic complexity in the overall technique, for example the pitch based waveform substitution technique. Although the complexity level of the calculation is low, it is significant for low-power platforms such as Bluetooth.

To efficiently compute an autocorrelation sequence, a Fourier Transform of the power spectrum of the signal is commonly used. However, the frequency domain approach is more memory intensive than direct calculation in the time domain and is only more efficient for longer input signal lengths and when a full autocorrelation is needed. For determining an estimated periodicity or pitch period of a signal on a resource constrained embedded platform, a direct time domain calculation is normally preferred.

To reduce computational load of a time domain approach, one commonly adopted approach is to perform pitch period estimation in two phases. ITU-T Recommendation G.711 Appendix 1, "A high quality low-complexity algorithm for packet loss concealment with G.711" proposes such a system. In the first phase, a coarse search is performed over the entire predefined range of pitch periods to determine a rough estimate of the pitch period. In the second phase, a fine search is performed over a refined range of pitch periods encompassing the rough estimate of the pitch period. A more accurate refined estimate of the pitch period can therefore be determined. The number of calculations that the algorithm computes is therefore reduced compared to an algorithm that performs a fine search over the entire predefined range of pitch periods.

Although this approach reduces the number of calculations that the algorithm computes, the computational complexity associated with estimating the pitch period remains a problem, particularly with low-power platforms such as Bluetooth.

There is thus a need for an improved method of estimating the pitch period or periodicity of a signal that reduces the computational complexity associated with the estimation.

SUMMARY OF THE INVENTION

According to one aspect of the invention, there is provided a method of estimating a pitch period of a first portion of a signal, the first portion overlapping a previous portion, the method comprising: computing a first autocorrelation value for part of the first portion not overlapping the previous portion; retrieving a stored second autocorrelation value for part of the first portion overlapping the previous portion, the second autocorrelation value having been computed during estimation of a pitch period of the previous portion; forming a combined autocorrelation value using the first and second autocorrelation values; and selecting the estimated pitch period in dependence on the combined autocorrelation value.

Suitably, the method comprises computing a first autocorrelation value for all of the first portion not overlapping the previous portion.

Suitably, the method comprises forming a combined autocorrelation value by combining the first and second autocorrelation values.

Suitably, the method further comprises computing a third autocorrelation value for part of the first portion not overlapping the previous portion and not overlapping a following portion.

Suitably, the method comprises forming a combined autocorrelation value by combining the first, second and third autocorrelation values.

Suitably, the method further comprises retrieving a stored third autocorrelation value for part of the first portion overlapping both the previous portion and a following portion, the third autocorrelation value having been computed during estimation of a pitch period of a portion preceding the previous portion.

Suitably, the method comprises forming a combined autocorrelation value by combining the first, second and third autocorrelation values.

Suitably, the method comprises computing the first autocorrelation value by correlating said part of the first portion not overlapping the previous portion with a part of the signal separated from said part by a potential pitch period.

Suitably, the method further comprises forming further combined autocorrelation values, each combined autocorrelation value formed using respective first and second autocorrelation values computed using a respective potential pitch period.

Suitably, the method comprises selecting the estimated pitch period to be the potential pitch period used in forming the combined autocorrelation value indicative of the highest correlation.

Suitably, the method further comprises storing the first autocorrelation value for use in estimating the pitch period of a following portion of the signal overlapping the first portion.

Suitably, the first portion consists of a number of samples which is an integer multiple of the number of samples in the overlapping part of the first portion.

Suitably, the first portion consists of a number of samples which is an integer multiple of the number of samples in the non-overlapping part of the first portion.

Suitably, the first portion is at least as long as the largest potential pitch period.

Suitably, a section of the signal is made available for use in computing the first autocorrelation value, the section of the signal being at least as long as the combined length of the first portion and the largest potential pitch period.

Suitably, the method comprises computing the first autocorrelation value using an average magnitude difference function, and wherein the second autocorrelation value was computed using an average magnitude difference function.

According to another aspect of the present disclosure, there is provided a method of estimating a periodicity of a first portion of a signal, the first portion overlapping a previous portion, the method comprising: computing a first autocorrelation value for part of the first portion not overlapping the previous portion; retrieving a stored second autocorrelation value for part of the first portion overlapping the previous portion, the second autocorrelation value having been computed during estimation of a periodicity of the previous portion; forming a combined autocorrelation value using the first and second autocorrelation values; and selecting the estimated periodicity in dependence on the combined autocorrelation value.

BRIEF DESCRIPTION OF THE DRAWINGS

The present invention will now be described by way of example with reference to the accompanying drawings. In the drawings.

DETAILED DESCRIPTION OF THE INVENTION

There are numerous well known algorithms commonly used in the art to detect the periodicity and/or pitch period of a signal. Examples of metrics utilised by these algorithms are normalised cross-correlation (NCC), average squared difference function (ASDF), and average magnitude difference function (AMDF). Algorithms utilising these metrics offer similar pitch period/voicing detection performance. The selection of one algorithm over another may often depend on the efficiency of the algorithm, which in turn may depend on the hardware platform being used. For example, in NCC, a division operation is required which is normally a costly operation. On some DSP processors, e.g. Cambridge Silicon Radio's Kalimba, a division can be parallelized to cost only one instruction cycle, which could make NCC a more efficient solution than AMDF.

The following description refers to the use of "autocorrelation" algorithms and metrics. The term autocorrelate is not intended to be limited to mean a specific mathematical operation. The term autocorrelate is used to express a method by which a measure of the similarity between two parts of a signal or data series can be determined. The measure is preferably a quantitative measure. An autocorrelation could involve computing a distance measure between two parts of a signal. Alternatively, an autocorrelation could involve other mechanisms. Examples of suitable autocorrelation metrics are NCC, ASDF and AMDF mentioned above.

Figure 1:
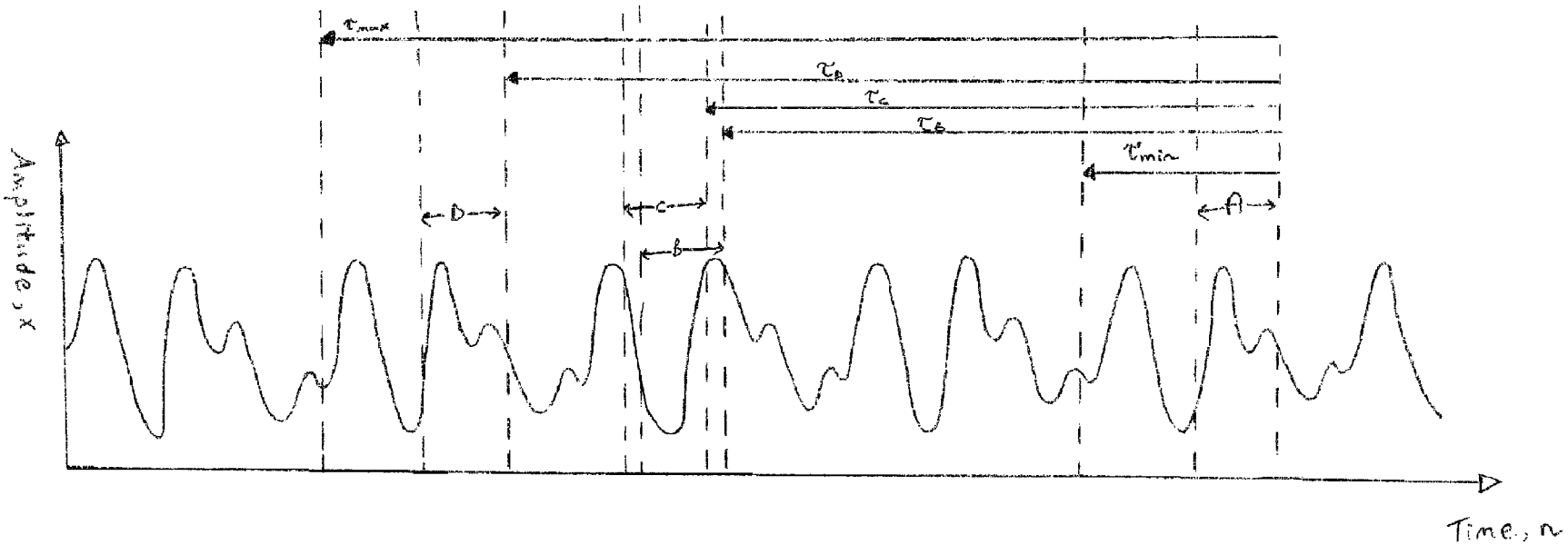
FIG. 1 illustrates a graph of a typical voice signal illustrating an autocorrelation algorithm.

FIG. 1 is a graph of a short time interval of a typical voice signal illustrating an autocorrelation metric.

To illustrate the method described herein, an average magnitude difference function (AMDF) metric will be used. However, the method is equally suitable for use with other metrics such as those mentioned above.

The AMDF metric can be expressed mathematically as:

$$AMDF_m[\tau] = \frac{1}{L}\sum_{n=m-L+1}^{m} x[n] - x[n-\tau]\Big| \qquad \text{(equation 1)}$$

where x is the amplitude of the voice signal and n is the time index. The equation represents a correlation between two segments of the voice signal which are separated by a time $\tau$. Each of the two segments is split up into L time samples. The absolute magnitude difference between the nth sample of the first segment and the respective nth sample of the other segment is computed. The number of samples, L, used in the AMDF metric lies in the range $0<L<N$, where N is the number of samples in the frame of the signal being analysed. m is the time instant at the end of the frame being analysed.

This equation is repeated over time separations incremented over the range $\tau_{min} \leqq \tau < \tau_{max}$. The aim of the method is to take a first segment of a signal (marked A on FIG. 1) and correlate it with each of a number of further segments of the signal (for ease of illustration only three, marked B, C and D, are shown on FIG. 1). Each of these further segments lags the first segment along the time axis by a lag value ($\tau_B$ for segment B, $\tau_C$ for segment C, and $\tau_D$ for segment D) in the range $\tau_{min}$ to $\tau_{max}$. The number of samples in the frame of the signal being analysed must be at least as large as the number of samples in the AMDF metric plus the maximum time separation $\tau_{max}$ in order to have enough samples to perform the AMDF function. In other words $N \geqq L+\tau_{max}$. The method results in an AMDF value for each $\tau$ value.

The range $\tau_{min} \leqq \tau < \tau_{max}$ is referred to herein as the potential pitch period range. A potential pitch period is a pitch period typically found in human voice signals. Typically, pitch periods of human speech range between 2.5 ms (for a person with a high voice) to 16 ms (for a person with a low voice). This corresponds to a pitch frequency range of 400 Hz to 62.5 Hz, or a sample range of 20 samples to 128 samples (for a sampling rate of 8 kHz). Suitably therefore, the low bound of the potential pitch period range is chosen to be 20 samples, and the high bound is chosen to be 128 samples. The pitch period of a voice signal is expected to be found in the range of potential pitch periods.

The pitch period in FIG. 1 is taken to be the value of $\tau$ which minimises the AMDF function. Mathematically, $$\tau_{m,0} = \underset{\tau}{\operatorname{argmin}} AMDF_m[\tau] \quad \text{(equation 2)}$$

The term 1/L has been dropped from equation 2 (and subsequent equations) for simplicity, since it is a constant throughout the system.

This pitch period estimate may be used as an estimate of the pitch period of the whole frame of N samples. Alternatively, the pitch period estimate may be used as an estimate of the pitch period of a shorter portion of the frame, for example just segment A. The index m in equation 2 identifies the estimated pitch period as being that of the segment ending in the mth sample. Pitch periods can be similarly estimated for other segments of the signal. These segments may be overlapping. In this way, the estimate of the pitch period of a signal can be continually updated as the signal is analysed.

The periodicity (also called harmonicity) can be expressed as 1 minus the ratio between the minimum of the AMDF function and the maximum of the AMDF function. Mathematically:

$$H = -\frac{\min(AMDF_m[\tau])}{\max(AMDF_m[\tau])} \quad \text{(equation 3)}$$

For a pure sinusoidal tone, the minimum AMDF function is found at the value of $\tau$ equal to the pitch period (or an integer multiple of the pitch period). This AMDF value is very small. The maximum AMDF function is found at a value of $\tau$ equal to half the pitch period. This AMDF value is large. However, since the minimum AMDF value is very small, the ratio between it and the maximum AMDF value is very small, and consequently the periodicity of a pure sinusoidal tone is almost 1.

A noise signal has no periodic structure. The difference between the minimum AMDF and maximum AMDF is small. Consequently, the ratio between the minimum and maximum AMDF values is close to 1. The periodicity of a noise signal is a value close to 0.

A voice signal is quasi-periodic. The difference between the minimum and maximum AMDF values is therefore large (although not as large as for a pure tone). The periodicity of a voiced signal is a value close to 1.

In implementations in which it is desired only to determine whether the signal is voiced or unvoiced, it is not necessary to determine the pitch period of the signal. The determination can be performed by evaluating the periodicity of the signal. If the signal exhibits a sufficient degree of periodicity (i.e. a value close to 1), it can be determined to be voiced. In such a case, a narrower range of potential pitch periods $\tau_{min} \leqq \tau < \tau_{max}$ can be used in the AMDF calculations than is described above. This is because it is only necessary to identify a null of the AMDF function, and a signal usually produces nulls on the AMDF function when $\tau$ equals integer multiples of the pitch period as well as the pitch period. For example, a signal with a pitch period of 40 samples (200 Hz) will produce a local minimum of the AMDF function at 40 samples, and another local minimum at 80 samples (100 Hz). By setting $\tau_{max} = 2\,\tau_{min}$, multiples of pitch periods less than $\tau_{min}$ will be picked up in the range $\tau_{min} \leqq \tau < \tau_{max}$. A pitch period range of 64 samples to 128 samples therefore covers all pitch periods less than 128 samples. This corresponds to a frequency range of 62.5 Hz to 125 Hz covering all pitch values higher than 62.5 Hz.

If an estimation of the pitch period is to be determined the whole of the range of potential pitch periods needs to be taken into account. It is, however, not necessary to evaluate the AMDF function of equation 1 at each potential pitch period in the range of potential pitch periods. As described above in relation to a calculation of the periodicity of a signal, a local minimum of the AMDF function will be produced for integer multiples of the pitch period as well as for the pitch period. The pitch period estimation can be carried out in two phases. Firstly, the AMDF function can be evaluated over a range of potential pitch periods from $\tau_{min} \leqq \tau < \tau_{max}$ where $\tau_{max} = 2\,\tau_{min}$. The candidate pitch period identified in this first phase may be a multiple of the true pitch period. In the second phase, the candidate pitch period is divided by one or more integer multiples to give further candidate pitch periods. The AMDF function is evaluated for these further candidate pitch periods. The value of $\tau$ resulting in the minimum AMDF function for the first and further candidate pitch periods is selected to be the estimate of the pitch period.

This method significantly reduces the algorithmic complexity involved in calculating the pitch period by reducing the number of calculations the algorithm performs.

However, even when evaluating the AMDF function over the top half of the range of potential pitch periods, i.e. from $\tau_{min} \leqq \tau < \tau_{max}$ where $\tau_{max} = 2\,\tau_{min}$ as described in relation to the calculations of periodicity and pitch period above, the calculational complexity can be significant for resource critical embedded devices.

Consider the equation for calculating the AMDF function (equation 1). For each value of $\tau$ there are L addition operations, L subtraction operations and L absolute operations. On a typical digital signal processor (DSP), these operations take one instruction cycle each. Excluding memory addressing operations, the total number of instruction cycles for evaluating the AMDF function over $\tau_{min} \leqq \tau < \tau_{max}$ is:

$$\text{number of instruction cycles} = 3L * \text{number of } \tau \text{ values} \quad \text{(equation 4)}$$

For example, if:

64 samples $\leqq \tau <$ 128 samples, and

L=128

N=256 then:

$$\text{number of instruction cycles} = 3*128*(128-64) = 24576 \text{ cycles} \quad \text{(equation 5)}$$

If, in the example, the input signal is processed in blocks, with the number of new samples in each block being 64 and the sampling rate being 8 KHz, then the time taken to sample one block is:

$$\begin{aligned} \text{time take to sample a block} &= \text{number of new samples/sampling rate} \\ &= 64/8000 \\ &= 0.008 \text{ seconds} \end{aligned} \quad \text{(equation 6)}$$

In order to keep up with the rate at which the signal is being inputted into the processor, the processor evaluates the instruction cycles associated with a block within the time taken to receive the new samples in a block. The rate at which the processor must process the instructions cycles is therefore given by:

$$\text{rate} = \text{number of instruction cycles/time taken to sample a block} = 24576/0.008 = 3.072 \text{ million instructions per second } (MIPS) \quad \text{(equation 7)}$$

3.072 MIPS is nontrivial for an embedded platform, especially given that pitch period or periodicity estimation is normally an auxiliary operation in a speech processing system.

The following provides a further method for reducing the algorithmic complexity associated with the autocorrelation metric by reducing the number of instructions per second that are processed by the DSP.

The number of samples, L, used in the AMDF metric preferably satisfies the following relation:

$$L \geqq \tau_{max} \quad \text{(equation 8)}$$

The number of samples, L, used in the AMDF metric is preferably more than or the same as the maximum potential pitch period. If this relation is satisfied then there is a high degree of certainty that the minimum of the AMDF function is at the pitch period of the signal. If the relation is not satisfied then there is a lower degree of certainty that the minimum of the AMDF function is at the pitch period of the signal.

Figure 2A:
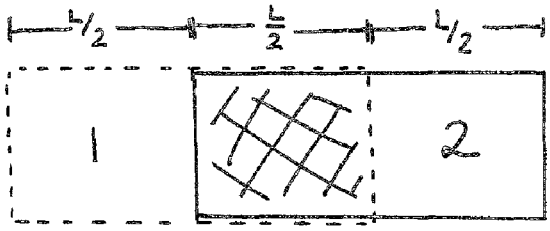
FIGS. 2*a*, 2*b* and 2*c* illustrate overlapping arrangements for blocks of a signal being processed.
Figure 2B:
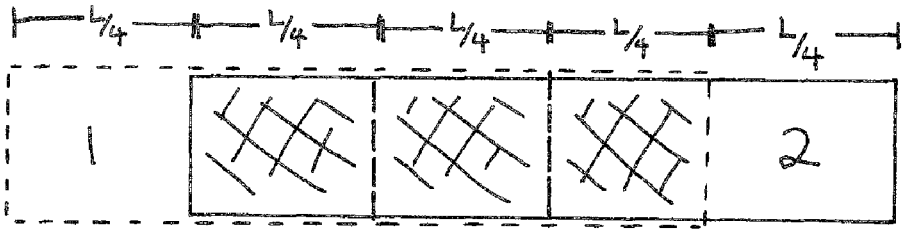
Figure 2C:
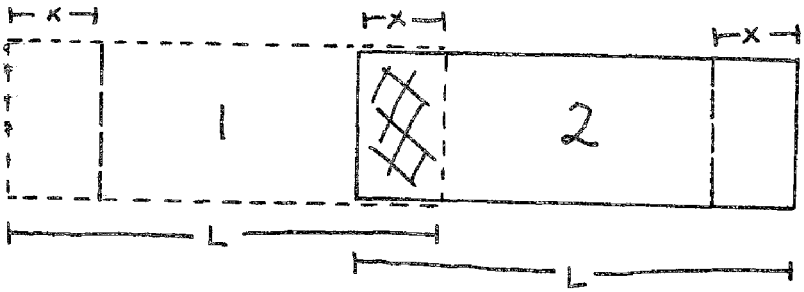

A suitable value for $\tau_{max}$ is 128 samples. In this case, L must be at least 128 samples. It is often desirable for the number of new samples in a block being analysed to be less than L. This means that both new samples and previously analysed samples are used in estimating the pitch period or periodicity using the AMDF metric. In other words, the blocks being analysed are overlapping. FIGS. 2*a*, 2*b* and 2*c* show three different example overlapping arrangements. Each figure depicts two adjacent blocks in the signal. Each block has a length L. The sections of the adjacent blocks that overlap with each other are indicated by hatched lines.

In FIG. 2*a* the blocks overlap by half of their length. That is, the last L/2 samples of the block marked 1 overlap with the first L/2 samples of the block marked 2. In this arrangement, the first L/2 samples of each block overlap with the last L/2 samples of the previous block, and the last L/2 samples of each block overlap with the first L/2 samples of the following block. The blocks overlap such that each sample is a member of two blocks. The number of new samples being analysed in each block is L/2.

In FIG. 2*b* the blocks overlap by three-quarters of their length. That is, the last 3L/4 samples of the block marked 1 overlap with the first 3L/4 samples of the block marked 2. In this arrangement, the blocks overlap such that each sample is a member of four blocks. The number of new samples being analysed in each block is L/4.

In FIG. 2*c* the last x samples of each block overlap with the first x samples of the following block, where x<L/2. The first x samples of each block overlap with the last x samples of the previous block, and the last x samples of each block overlap with the first x samples of the following block. 2x samples of each block are members of two blocks, and L−2x samples of each block are members of that block only. The number of new samples being analysed in each block is L−x.

Arrangements in which the blocks overlap by a greater proportion of their length are preferable in that pitch period estimates are determined more regularly, and hence the estimate of the pitch period of the signal at any time is more accurate than for a signal in which the blocks do not have as large an overlap. However, the more the blocks overlap, the greater the number of calculations that are to be performed in the time taken to receive the new samples of the block. The example calculations shown above in equations 6 and 7 are based on the overlapping arrangement shown in FIG. 2*a* in which each sample is in the first half of one block and the last half of the previous block.

For each block being analysed, the AMDF function is a summation over L samples of the absolute operation $|x[n]-x[n-\tau]|$. In the method described herein, the determination of the AMDF function is split up into discrete parts corresponding to summations of the absolute operation over different groups (subsets) of the L samples. For each block, the partial AMDF function of at least one of these groups of samples is calculated directly using equation 1 and the method described above. For each block, the partial AMDF function of at least one of the groups of samples computed using equation 1 is stored for later use. The partial AMDF function of each group of samples that overlaps with a group of samples in the following block is stored for later use. For each block, the partial AMDF function of a group of samples that overlaps with a group of samples of a previous block is not directly calculated using equation 1. This partial AMDF function has been previously computed and stored during AMDF evaluation for a previous block. This stored partial AMDF function is retrieved for use in AMDF evaluation of the current block. The discrete partial AMDF functions relating to the current block are combined to give the overall AMDF function for the block. Generally, this combination involves summing the one or more partial AMDF functions retrieved from the store (for those samples overlapping with a previous block) and the one or more partial AMDF functions calculated directly using equation 1 (for those samples not overlapping with a previous block).

The use of this method is now described in relation to the three overlapping arrangements shown in FIGS. 2*a, b* and *c*.

Figure 3A:
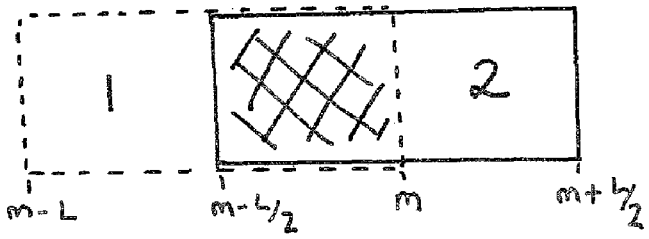
FIGS. 3*a*, 3*b* and 3*c* illustrate overlapping arrangements for blocks of a signal being processed.

FIG. 3*a* illustrates the overlapping arrangement of FIG. 2*a*. The AMDF function for each of blocks 1 and 2 is split up into two discrete parts, each comprising L/2 samples.

For the block marked 1 ending in sample m, the AMDF function can be expressed as:

$$\text{AMDF}_m = \text{AMDF}_{m-L+1\to m-(L/2)} + \text{AMDF}_{m-(L/2)+1\to m} \quad \text{(equation 9)}$$

where the subscripts to the partial AMDF functions indicate the range of samples over which the absolute operation $|x[n]-x[n-\tau]|$ is summed for each partial AMDF function. The first partial AMDF function is for summation over the group of samples starting at m−L+1 and ending at m−(L/2). The second partial AMDF function is for the group of samples starting at m−(L/2)+1 and ending at m. Partial $\text{AMDF}_{m-L+1\to m-(L/2)}$ was computed directly using equation 1 for the block previous to block 1, and stored in a buffer. This first partial AMDF is retrieved from the buffer for use in determining $\text{AMDF}_m$. Partial $\text{AMDF}_{m-(L/2)+1\to m}$ is for the group of samples of block 1 that are new, i.e. that have not previously been used in an AMDF calculation. This second partial AMDF is calculated directly using equation 1. The result is stored in a buffer. Additionally, the result is added to the first partial AMDF to give the combined $\text{AMDF}_m$ for block 1 as per equation 9.

For the block marked 2 ending in sample m+(L/2), the AMDF function can be expressed as:

$$\text{AMDF}_{m+(L/2)} = \text{AMDF}_{m-(L/2)+1\to m} + \text{AMDF}_{m+1\to m+(L/2)} \quad \text{(equation 10)}$$

The first partial AMDF function in equation 10 is for the group of samples starting at m−(L/2)+1 and ending at m. The second partial AMDF function in equation 10 is for the group of samples starting at m+1 and ending at m+(L/2).

$AMDF_{m-(L/2)+1\rightarrow m}$ was computed directly for the second half of the samples in block 1 and stored in a buffer. This partial AMDF is retrieved from the buffer. Partial $AMDF_{m+1\rightarrow m+(L/2)}$ is for the group of samples of block 2 that are new, i.e. were not calculated in determining $AMDF_m$ for block 1. This second partial AMDF is calculated directly using equation 1. The result is stored in a buffer for use with the AMDF determination of the following block. Additionally, the result is added to the first partial AMDF to give the combined $AMDF_{m+(L/2)}$ for block 2 as per equation 10. Once the stored partial AMDF values have been used in a subsequent calculation they can be deleted from the buffer.

The example calculations for the processing capacity of the DSP shown above in equations 6 and 7 can be recalculated according to the method described.

For each complete AMDF function, the number of instruction cycles has dropped by half, since equation 1 is only computed over L/2 of the samples: the partial AMDF for the remaining L/2 samples being retrieved from the buffer. Excluding memory addressing operations, the total number of instruction cycles for evaluating the AMDF function over $\tau_{min} \leqq \tau < \tau_{max}$ is:

$$\text{number of instruction cycles} = 3L/2 * \text{number of } \tau \text{ values} \quad \text{(equation 11)}$$

For example, if:

64 samples$\leqq\tau$<128 samples, and

L=128

N=256 then:

$$\text{number of instruction cycles} = 3*(128/2)*(128-64) = 12288 \text{ cycles} \quad \text{(equation 12)}$$

If the number of new samples in each block is 64 and the sampling rate is 8 KHz, then the time taken to sample one block is:

$$\begin{aligned}\text{time take to sample a block} &= \text{number of new samples/sampling rate} \\ &= 64/8000 \\ &= 0.008 \text{ seconds}\end{aligned} \quad \text{(equation 13)}$$

The rate at which the processor must process the instructions cycles is therefore given by:

$$\begin{aligned}\text{rate} &= \text{number of instruction cycles/time taken to sample a block} \\ &= 12288/0.008 \\ &= 1.536 \text{ million instructions per second } (MIPS)\end{aligned} \quad \text{(equation 14)}$$

This is half the processing rate calculated in equation 7.

Figure 3B:
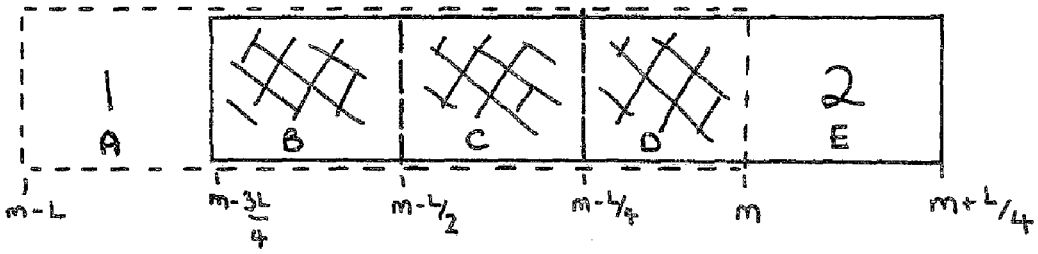

FIG. 3*b* illustrates the overlapping arrangement of FIG. 2*b*. The AMDF functions for each of blocks 1 and 2 is split up into four discrete parts, each comprising L/4 samples.

For the block marked 1 ending in sample m, the AMDF function can be expressed as:

$$AMDF_m = AMDF_{m-L+1\rightarrow m-(3L/4)} + AMDF_{m-(3L/4)+1\rightarrow m-(L/2)} + AMDF_{m-(L/2)+1\rightarrow m-(L/4)} + AMDF_{m-(L/4)+1\rightarrow m} \quad \text{(equation 15)}$$

The first partial AMDF function is for the part of the block marked A on FIG. 3. This is the group of samples starting at m−L+1 and ending at m−(3L/4). Since the blocks of FIG. 3*b* overlap by ¾ of their length, this partial AMDF function was calculated directly when determining the AMDF function for the block three blocks previous to block 1. This partial AMDF function was stored in a buffer after it was first calculated, and was reused in AMDF determinations for each of the two blocks previous to block 1. This partial AMDF is retrieved from the buffer for use in determining the AMDF function for block 1. The second partial AMDF function is for the part of the block marked B on FIG. 3*b*. This is the group of samples starting at m−(3L/4)+1 and ending at m−(L/2). The third partial AMDF function is for the part of the block marked C on FIG. 3*b*. This is the group of samples starting at m−(L/2)+1 and ending at m−(L/4). As with A, the second and third partial AMDF functions were calculated directly for previous blocks and stored in a buffer. These partial AMDFs are retrieved from the buffers for use in determining the AMDF function for block 1. Partial $AMDF_{m-(L/4)+1\rightarrow m}$ is for the group of samples of block 1 that are new, i.e. that have not previously been used in an AMDF calculation. This fourth partial AMDF is calculated directly using equation 1. The result is stored in a buffer. Additionally, the result is added to the first, second and third partial AMDFs to give the combined $AMDF_m$ for block 1, as per equation 15.

For the block marked 2 ending in sample m+(L/4), the AMDF function can be expressed as:

$$AMDF_{m+(L/4)} = AMDF_{m-(3L/4)+1\rightarrow m-(L/2)} + AMDF_{m-(L/2)+1\rightarrow m-(L/4)} + AMDF_{m-(L/4)+1\rightarrow m} + AMDF_{m+1\rightarrow m+(L/4)} \quad \text{(equation 16)}$$

The first partial AMDF function in equation 16 is for the group of samples starting at m−(3L/4)+1 and ending at m−(L/2). The second partial AMDF function in equation 16 is for the group of samples starting at m−(L/2)+1 and ending at m−(L/4). The third partial AMDF function is for the group of samples starting at m−(L/4)+1 and ending at m. The fourth partial AMDF function is for the group of samples starting at m+1 and ending at m+(L/4). The first, second and third partial AMDF functions have previously been computed for AMDF determinations of previous blocks. These are all retrieved from the buffer or buffers in which they are stored. Partial $AMDF_{m+1\rightarrow m+(L/4)}$ is for the group of samples of block 2 that are new, i.e. were not used in determining $AMDF_m$ for block 1. This fourth partial AMDF is calculated directly using equation 1. The result is stored in a buffer for use with the AMDF determination of the following block. Additionally, the result is added to the first, second and third partial AMDFs to give the combined $AMDF_{m+(L/4)}$ for block 2, as per equation 16. Once the stored partial AMDF values have been used in three AMDF determinations subsequent to the AMDF determination for which they were computed, they can be deleted from the buffer.

FIGS. 2*b* and 3*b* illustrate an overlapping arrangement in which the number of new samples (K) in each block is less than half of the number of samples in the block, L. If K<L/2 it is preferable that L is a multiple integer of K, in other words that mod(L,K)=0. For each time lag $\tau$ the buffer/memory stores (L/K)−1 elements. For example, in FIG. 3*b* K=L/4 and for each AMDF determination three partial AMDF values are stored in the buffer. Suitably, these elements are stored as a queue of (L/K)−1 elements. After computing the partial AMDF value for the new K samples, the queue is updated by pushing the newly computed AMDF value into the queue and removing the oldest AMDF value from the other end of the queue.

Figure 3C:
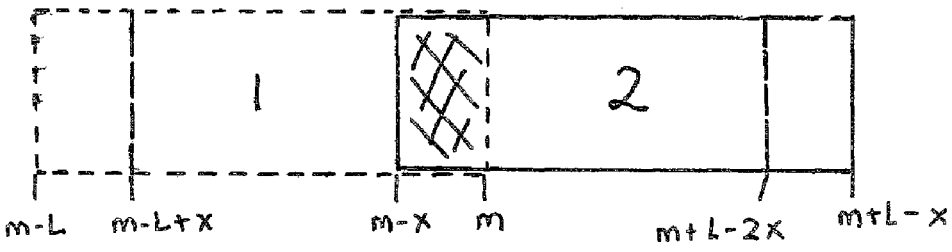

FIG. 3*c* illustrates the overlapping arrangement of FIG. 2*c*. The AMDF function for each of blocks 1 and 2 is split up into three discrete parts, the first and last each comprising x samples and the middle comprising L−2x samples.

For the block marked 1 ending in sample m, the AMDF function can be expressed as:

$$AMDF_m = AMDF_{m-L+1\to m-L+x} + AMDF_{m-L+x+1\to m-x} + AMDF_{m-x+1\to m} \quad \text{(equation 17)}$$

The first partial AMDF function is for the part of the block comprising the group of samples starting at m−L+1 and ending at m−L+x. This partial AMDF function was calculated directly when determining the AMDF function for the block previous to block 1, and stored. This partial AMDF is retrieved from the store for use in determining the AMDF function for block 1. The second partial AMDF function is for the part of the block comprising the group of samples starting at m−L+x+1 and ending at m−x. These are new samples in block 1. This second partial AMDF function has not previously been computed, and is therefore computed for block 1 using equation 1. The resulting partial AMDF function is used in the determination of the AMDF function for block 1, but is not stored in a buffer. This is because this group of samples is not in the part of block 1 that overlaps with a subsequent block and hence the partial AMDF value for this group of samples is not used in a subsequent AMDF determination for a subsequent block. The third partial AMDF function is for the part of the block comprising the group of samples starting at m−x+1 and ending at m. These are also new samples for block 1. This third partial AMDF is therefore also computed directly using equation 1. However, since these samples are in the part of block 1 that overlaps with block 2, once computed the partial AMDF value for this group of samples is stored in the buffer/memory for use in the AMDF determination of block 2. Additionally, this partial AMDF value is added to the first and second partial AMDFs to give the combined $AMDF_m$ for block 1 as per equation 17.

For the block marked 2 ending in sample m+L−x, the AMDF function can be expressed as:

$$AMDF_{m+L-x} = AMDF_{m-x+1\to m} + AMDF_{m+1\to m+L-2x} + AMDF_{m+L-2x+1\to m+L-x} \quad \text{(equation 18)}$$

The first partial AMDF function in equation 18 is for the group of samples starting at m−x+1 and ending at m. The second partial AMDF function in equation 18 is for the group of samples starting at m+1 and ending at m+L−2x. The third partial AMDF function is for the group of samples starting at m+L−2x+1 and ending at m+L−x. The first partial AMDF function was previously computed for block 1 and stored. This AMDF value is retrieved from the buffer. The second and third partial AMDF functions are for groups of samples of block 2 that are new, i.e. were not used in determining $AMDF_m$ for block 1. These partial AMDFs are calculated directly using equation 1. The third partial AMDF is stored in a buffer for use with the AMDF determination of the following block. The second and third partial AMDF values are added to the first partial AMDF to give the combined $AMDF_{m+L-x}$ for block 2 as per equation 18. The second partial AMDF is then discarded. Once the stored partial AMDF values have been used in a subsequent AMDF determination after the AMDF determination for which they were computed, they are deleted from the buffer.

FIGS. 2*c* and 3*c* illustrate an overlapping arrangement in which the number of new samples (K) in each block is greater than half of the number of samples in the block, L. If K>L/2 it is preferable that K is a multiple integer of L<K, in other words that mod(K,L−K)=0. The K new samples are split up into K/(L−K) segments, and only the AMDF value of the last segment is stored in the buffer/memory.

The arrangement of FIGS. 2*a* and 3*a* is the most preferable of those shown in FIGS. 2 and 3 in terms of providing a balance between updating the estimated pitch period or periodicity of a signal and maintaining the processing power required for memory addressing operations and calculations at a low level.

The method of reducing the computational cost associated with a time domain autocorrelation method as described herein, can be combined with other computational saving measures. For example, it can be combined with a multi-phase pitch estimation method as described in the background section, in which the pitch period is first coarsely estimated and then more finely estimated. As a further example, this method can be combined with decimation. Decimation is the process of removing or discounting samples at regular intervals. Decimation may be applied to the input signal and/or the lag values τ. For example, referring to equation 1 and FIG. 1, applying a decimation of 2:1 to the input signal means that every other sample of segment A will be correlated against the corresponding every other sample of segment B, and so on. Similarly, applying a decimation of 2:1 to the lag values τ means that the calculation of equation 1 is carried out for every other possible τ value, for example 64 samples, 66 samples, 68 samples and so on. Decimating either the input signal or the lag value allows a reduction in processing complexity (of 50% for each 2:1 decimation) at the expense of some performance degradation.

The method described herein achieves a significant reduction in the algorithmic complexity involved in determining the pitch period or periodicity of overlapping blocks of a signal. The method makes use of blocks that have a regular overlapping arrangement. Preferably, the overlapping arrangement is such that each block overlaps the previous block by the same number of samples as the number of samples by which it overlaps the following block.

Figure 4:
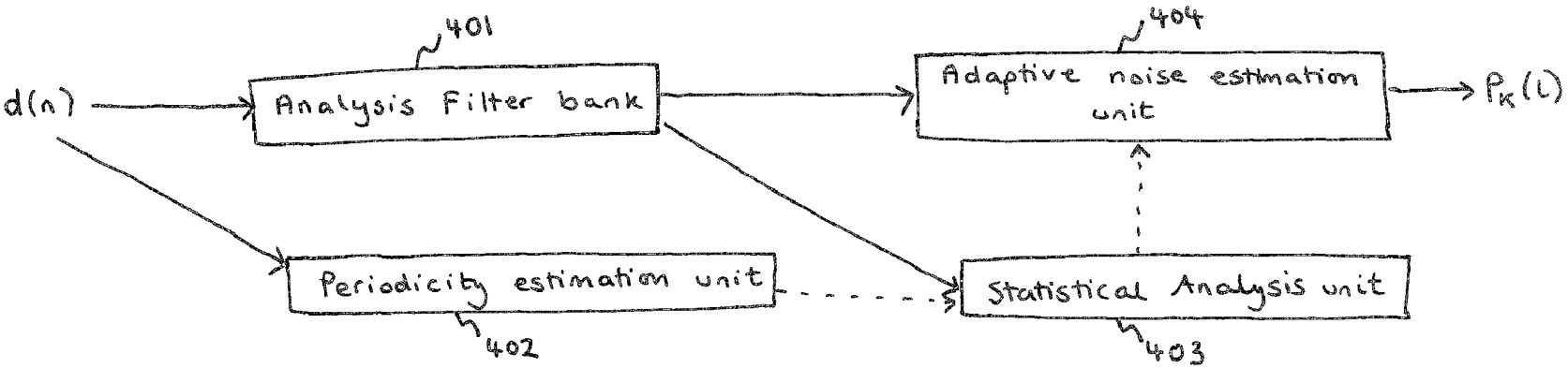
FIG. 4 illustrates a schematic diagram of a signal processing apparatus according to the present disclosure.

As previously mentioned, the method described herein is suitable for use in applications in signal processing systems in which the periodicity or pitch period of a signal are estimated. One such example application is noise suppression. FIG. 4 shows an example logical architecture for implementation in a device for estimating noise in a source audio signal. The dashed arrows indicate that the outputs of modules 402 and 403 control the operation of the units to which they are input.

The source audio signal d(n) is applied to an analysis filter bank 401. The analysis filter bank filters d(n) to produce a series of sub-band signals and downsamples each of these sub-band signals to average their power.

The source audio signal d(n) is also applied to a periodicity estimation unit 402. The periodicity estimation unit determines the voicing status of the signal in accordance with the method described herein. The periodicity estimation unit generates an output indicative of whether the signal is voiced or unvoiced.

The outputs of the analysis filter bank 401 and periodicity estimation unit 402 are provided to a statistical analysis unit 403. The statistical analysis unit 403 generates minimum statistics information about the output of the analysis filter bank 401 in a manner that is dependent on the output of the periodicity estimation unit 402. For example, if the periodicity estimation unit indicates that the signal is voiced, the minimum statistical analysis may be omitted. However, if the periodicity estimation unit indicates that the signal is unvoiced, the minimum statistical analysis is completed. The minimum statistical analysis unit searches for a minimum value of the signal. A correction value may be generated for use in the adaptive noise estimation unit 404.

The adaptive noise estimation unit 404 adaptively estimates the noise in each sub-band of the signal by processing the output of analysis filter bank 401 in a manner that is dependent on the output of the statistical analysis unit 403.

The resulting noise power estimate Pk(I) can then be used to substantially remove the noise component from the audio signal.

The system described above could be implemented in dedicated hardware or by means of software running on a microprocessor. The system is preferably implemented on a single integrated circuit.

Figure 5:
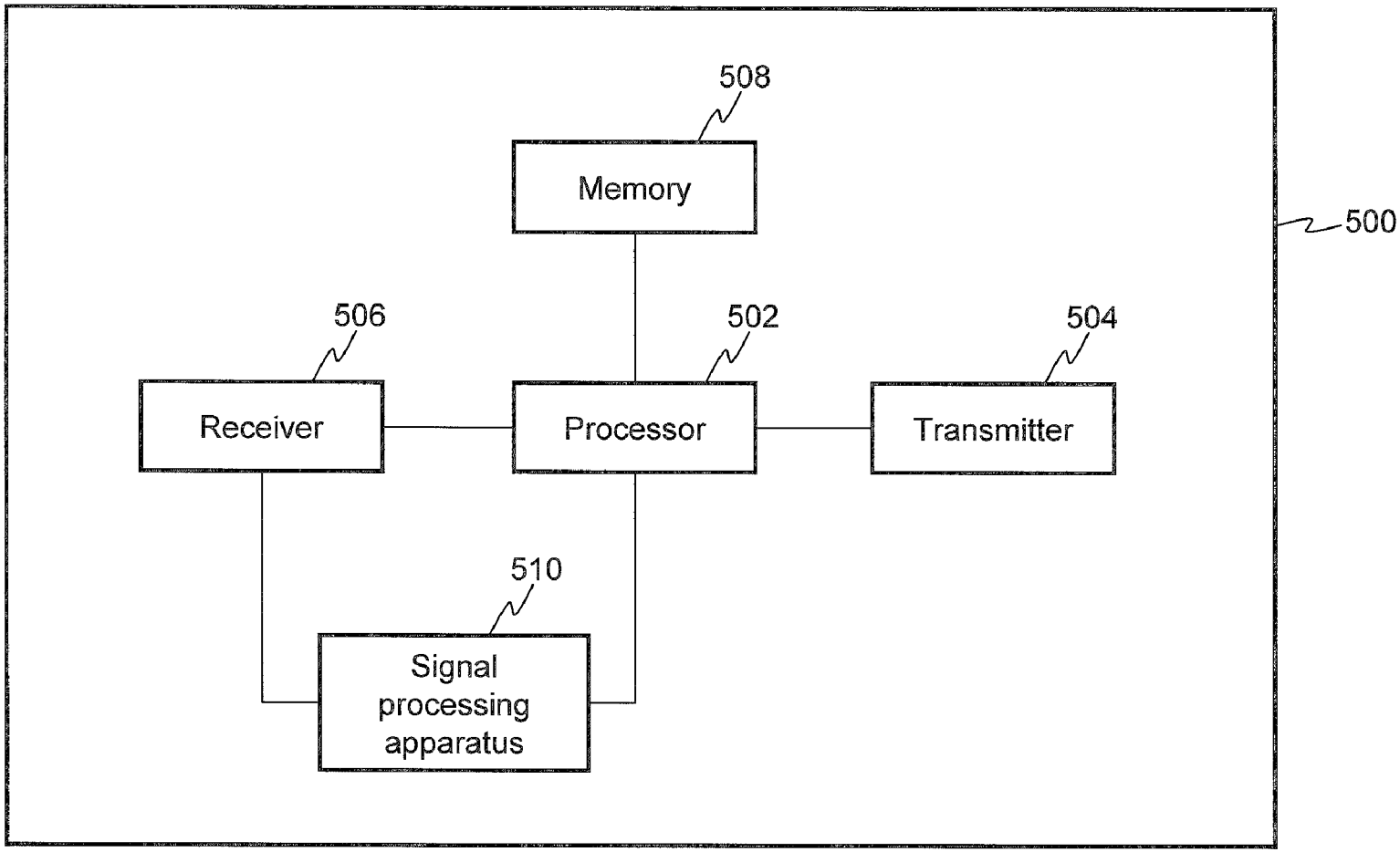
FIG. 5 illustrates a schematic diagram of a transceiver suitable for comprising the signal processing apparatus of FIG. 4.

The noise suppression apparatus of FIG. 4 could usefully be implemented in a transceiver. FIG. 5 illustrates such a transceiver 500. A processor 502 is connected to a transmitter 504, a receiver 506, a memory 508 and a signal processing apparatus 510. Any suitable transmitter, receiver, memory and processor known to a person skilled in the art could be implemented in the transceiver. Preferably, the signal processing apparatus 510 comprises the apparatus of FIG. 4. The signal processing apparatus is additionally connected to the receiver 506. The signals received and demodulated by the receiver may be passed directly to the signal processing apparatus for processing. Alternatively, the received signals may be stored in memory 508 before being passed to the signal processing apparatus. The transceiver of FIG. 5 could suitably be implemented as a wireless telecommunications device. Examples of such wireless telecommunications devices include handsets, desktop speakers and handheld mobile phones.

The applicant draws attention to the fact that the present invention may include any feature or combination of features disclosed herein either implicitly or explicitly or any generalisation thereof, without limitation to the scope of any of the present claims. In view of the foregoing description it will be evident to a person skilled in the art that various modifications may be made within the scope of the invention.

The invention claimed is:

1. A method of estimating a pitch period of a first portion of a signal inputted to a signal processing apparatus, the first portion overlapping a previous portion of said signal, the method comprising the signal processing apparatus performing the following:

computing a first autocorrelation value for part of the first portion not overlapping the previous portion;

retrieving a stored second autocorrelation value for part of the first portion overlapping the previous portion, the second autocorrelation value having been computed during estimation of a pitch period of the previous portion;

forming a combined autocorrelation value using the first and second autocorrelation values; and selecting the estimated pitch period in accordance with the combined autocorrelation value.

2. A method as claimed in claim 1, comprising computing a first autocorrelation value for all of the first portion not overlapping the previous portion.

3. A method as claimed in claim 2, comprising forming a combined autocorrelation value by combining the first and second autocorrelation values.

4. A method as claimed in claim 1, further comprising computing a third autocorrelation value for part of the first portion not overlapping the previous portion and not overlapping a following portion.

5. A method as claimed in claim 4, comprising forming a combined autocorrelation value by combining the first, second and third autocorrelation values.

6. A method as claimed in claim 1, further comprising retrieving a stored third autocorrelation value for part of the first portion overlapping both the previous portion and a following portion, the third autocorrelation value having been computed during estimation of a pitch period of a portion preceding the previous portion.

7. A method as claimed in claim 6, comprising forming a combined autocorrelation value by combining the first, second and third autocorrelation values.

8. A method as claimed in claim 1, comprising computing the first autocorrelation value by correlating said part of the first portion not overlapping the previous portion with a part of the signal separated from said part by a potential pitch period.

9. A method as claimed in claim 8, further comprising forming further combined autocorrelation values, each combined autocorrelation value formed using respective first and second autocorrelation values computed using a respective potential pitch period.

10. A method as claimed in claim 9, comprising selecting the estimated pitch period to be the potential pitch period used in forming the combined autocorrelation value indicative of the highest correlation.

11. A method as claimed in claim 1, further comprising storing the first autocorrelation value for use in estimating the pitch period of a following portion of the signal overlapping the first portion.

12. A method as claimed in claim 1, wherein the first portion consists of a number of samples which is an integer multiple of the number of samples in the overlapping part of the first portion.

13. A method as claimed in claim 1, wherein the first portion consists of a number of samples which is an integer multiple of the number of samples in the non-overlapping part of the first portion.

14. A method as claimed in claim 1, wherein the first portion is at least as long as the largest potential pitch period.

15. A method as claimed in claim 1, wherein a section of the signal is made available for use in computing the first autocorrelation value, the section of the signal being at least as long as the combined length of the first portion and the largest potential pitch period.

16. A method as claimed in claim 1, comprising computing the first autocorrelation value using an average magnitude difference function, and wherein the second autocorrelation value was computed using an average magnitude difference function.

17. A method of estimating a periodicity of a first portion of a signal inputted to a signal processing apparatus, the first portion overlapping a previous portion of said signal, the method comprising the signal processing apparatus performing the following:

computing a first autocorrelation value for part of the first portion not overlapping the previous portion;

retrieving a stored second autocorrelation value for part of the first portion overlapping the previous portion, the second autocorrelation value having been computed during estimation of a periodicity of the previous portion;

forming a combined autocorrelation value using the first and second autocorrelation values; and selecting the estimated periodicity in accordance with the combined autocorrelation value.

* * * * *